US006860447B2

(12) United States Patent
Boone et al.

(10) Patent No.: US 6,860,447 B2
(45) Date of Patent: Mar. 1, 2005

(54) DISPENSER FOR WEB PAPER PRODUCT

(75) Inventors: Bruce T. Boone, Roswell, GA (US); John J. Diggins, St. Augustine, FL (US)

(73) Assignee: Fort James Corporation, Atlanta, GA (US)

( * ) Notice: Subject to any disclaimer, the term of this patent is extended or adjusted under 35 U.S.C. 154(b) by 35 days.

(21) Appl. No.: 10/183,997

(22) Filed: Jun. 28, 2002

(65) Prior Publication Data

US 2004/0000611 A1 Jan. 1, 2004

(51) Int. Cl.[7] ..... B65H 75/28
(52) U.S. Cl. ..... 242/579; 242/564.1
(58) Field of Search ..... 242/579, 580, 242/580.1, 596.3, 596.8, 564, 564.1, 564.3, 564.4, 565, 566

(56) References Cited

U.S. PATENT DOCUMENTS

| | | | | | |
|---|---|---|---|---|---|
| 482,119 | A | * | 9/1892 | Evans | 242/564.1 |
| 2,146,038 | A | * | 2/1939 | West | 242/564.4 |
| 2,193,759 | A | * | 3/1940 | Birr | 225/14 |
| 2,202,011 | A | | 5/1940 | Krueger et al. | |
| 2,206,978 | A | | 7/1940 | Steiner | |
| 2,206,979 | A | | 7/1940 | Steiner | |
| 2,215,052 | A | | 9/1940 | Price et al. | |
| 2,380,644 | A | * | 7/1945 | Grondona | 242/596.8 |
| 3,128,024 | A | | 4/1964 | Downham | |
| 3,152,739 | A | * | 10/1964 | McWilliams | |
| 3,217,953 | A | | 11/1965 | Bahnsen | |
| 3,507,428 | A | | 4/1970 | Leibreich | |
| 3,575,328 | A | * | 4/1971 | Jespersen et al. | 225/106 |
| 3,837,549 | A | | 9/1974 | Sengewald | |
| 4,192,442 | A | * | 3/1980 | Bastian et al. | 242/564.4 |
| 4,569,467 | A | | 2/1986 | Kaminstein | |
| 4,579,267 | A | | 4/1986 | Planke | |
| 4,621,755 | A | * | 11/1986 | Granger | 225/106 |
| 4,716,799 | A | | 1/1988 | Hartmann | |
| 4,770,322 | A | * | 9/1988 | Slota et al. | |
| 4,823,663 | A | * | 4/1989 | Hamlin | 83/208 |
| 5,048,386 | A | * | 9/1991 | DeLuca et al. | 225/106 |
| 5,328,071 | A | | 7/1994 | Aihara | |
| 5,407,115 | A | | 4/1995 | Blalock et al. | |
| 5,452,832 | A | | 9/1995 | Niada | |
| 5,704,566 | A | * | 1/1998 | Schutz et al. | 242/595 |
| 5,772,291 | A | | 6/1998 | Byrd et al. | |
| 5,860,578 | A | | 1/1999 | Laguna | |
| 5,979,822 | A | * | 11/1999 | Morand et al. | 242/564.2 |
| 6,105,898 | A | | 8/2000 | Byrd et al. | |
| 6,412,679 | B2 | * | 7/2002 | Formon et al. | 225/106 |
| 6,446,901 | B1 | * | 9/2002 | Haen et al. | 242/564.1 |

* cited by examiner

*Primary Examiner*—William A. Rivera
(74) *Attorney, Agent, or Firm*—Banner & Witcoff, Ltd.

(57) ABSTRACT

A powered dispenser for dispensing a perforated web of sheet material includes an internal well which holds a dispensed segment of the paper web for separation by a user. The well may include a concave portion attached to an elongated upwardly inclined portion that extends to a discharge opening. A separating member in the well is provided so that the dispensed segment can be pulled against it to separate the segment at the tear lines with a substantially reduced pull force. The separating member may have a symmetrical configuration and an asymmetrical configuration. The separating member is pivotally configured so as to rotate towards or away the discharge opening for actuating the feed mechanism when a force is applied to a portion of a dispensed segment.

29 Claims, 10 Drawing Sheets

DISPENSER FOR WEB PAPER PRODUCT

FIELD OF INVENTION

The present invention generally relates to a dispenser, and more particularly to a powered dispenser which dispenses a web of sheet material.

BACKGROUND OF THE INVENTION

Napkin dispensers have been used in commercial food service establishments, such as fast food restaurants. These establishments offer service at a counter or in a cafeteria environment and typically furnish paper products, such as napkins or paper towels, to their customers for wiping their hands, faces, etc. These paper products are typically furnished to customers in folded napkins, unperforated rolled towels or folded towel in a stack. A newer type of paper product includes perforated sheets that allow ease of delivery of paper to the customer. Paper products are either available in dispensers located throughout the restaurant or presented to the customers at the counter when they receive their food order.

Commercial food service establishments serve a variety of people and groups of the population. Business may depend on various consumer expectations, such as speed of service and general cleanliness of the establishment. Unfortunately, some dispensers may invoke undesirable health and sanitation anxiety for consumers in these establishments. Some dispensers position a sheet of paper which has a surface area that may have been soiled or may have been contacted by a previous customer. In such cases, the customer attempting to retrieve the paper sheet may allow additional sheets to be dispensed and discard the first sheet. Consequently, this process causes a waste of paper and resources, increases operating costs to the establishment, and may reduce business because of lower consumer expectations of cleanliness.

Notwithstanding the sanitation drawbacks of dispensers, paper products supplied in perforated sheets may lack proper perforations or the perforations in the paper may vary so much that a manually applied force to separate the sheets is too high for some individuals. As a result, certain individuals may have difficulty removing paper products from some dispensers. In particular, a segment of the population such as, children, persons with disabilities, and the elderly may have insufficient musculoskeletal strength or control of the hands or fingers to remove paper products from dispensers. Furthermore, these problems are magnified for a segment of the population who may be amputees or disabled that have less than full use or their arms and fingers.

A further problem may occur when perforated paper napkins or towels can not be effectively separated from each other. Paper products in perforated sheets may lack proper perforations or the perforations in the paper may vary so that a manually applied force to separate the sheets is high. This presents undesirable consequences when some dispensers are placed so that they rest freestanding on a support surface, such as a table or shelf or the like. Because of the inability to effectively separate the sheets and the high separation force, there is a danger that the dispenser may be pulled towards the user or off the support surface onto the floor and become damaged or cause injury to the user. As a result, an establishment may not adequately meet the needs of the consuming public.

Typically for restroom environments, dispensers for non-perforated paper may include a lever, crank, or other user-contact mechanism for dispensing a length of paper, and a blade for severing the length of paper from the remaining roll. Unfortunately, manual contact with a dispenser or the like presents health concerns for consumers. Past dispenser configurations, as such shown U.S. Pat. No. 2,215,052 to Price; U.S. Pat. No. 2,202,011 to Krueger; U.S. Pat. No. 3,128,024 to Downham; and U.S. Pat. No. 5,860,578 to Laguna use manual cranks and require a consumer to position a sheet of paper to undesirable environments. In addition, such designs do not address the health concerns because, in part, a sheet of paper can be soiled as well. Moreover, individuals with insufficient musculoskeletal strength or who may be amputees or disabled would have a difficult time separating the paper from the roll or operate the cranks or levers.

Non-perforated paper has been used in electrical powered dispensers. In one example, U.S. Pat. No. 4,579,267 issued to Planke illustrates a paper imprinting device which has a bendable deflector and a blade which cuts heat-sensitive paper. After paper is fed from the imprinting device, a user pulls the paper which contacts the bendable deflector. In this construction, the underside of the cover forciably pushes a heatable imprinting member against the heat sensitive paper on an advancing roller. The imprinting device of Planke is problematic for separating perforated paper, in particular napkins and paper towels. Perforated paper can prematurely tear on the imprinting member, while the paper advances against the member. As a result, the premature tearing of the paper can jam the feeding operation of the paper and can improperly print the paper. Furthermore, this jamming problem wastes paper and resources.

In the Planke device, a paper towel or napkin needs be provided with sufficient strength to bend the deflector and reach the blade without premature and/or uneven tearing of the paper. Paper product possessing the requisite strength to be used with a dispenser of this type may be limited in the amount of softness and absorbency which can be provided to the paper towels and napkins. Moreover, the bendable deflector creates undesired resistance on the paper which in turn causes a greater force magnitude a user must manually place on the paper to remove it. Consequently, such a dispenser construction can cause a dispenser to be pulled towards a user and individuals with limited musculoskeletal strength or who may be amputees or disabled would have difficulty.

Some electrical powered dispensers which dispense non-perforated paper reduce manual contact with the housing. As shown in U.S. Pat. No. 5,452,832 to Niada and U.S. Pat. No. 5,772,291 to Byrd, a light sensitive device is used to detect the presence of a user's hand in front of the dispenser and advance the toweling for a predetermined length of time. The dispensed length of paper is then separated from the continuous web by pulling the paper against a serrated cutting blade. The devices of Niada and Byrd are ill-suited for separating perforated paper, in particular napkins and paper towels. The cutting action still requires the paper to possess a certain minimum strength, and generally produces a rough, unsightly cut. In addition, these designs still present a full sheet of paper to the undesirable environments, thus not effectively alleviating health and sanitation hazards for consumers.

SUMMARY OF THE INVENTION

The present invention pertains to a powered dispenser for dispensing a web of sheet material that overcomes the deficiencies in the relevant art.

According to an aspect of the present invention, a dispenser includes an internal well to retain a dispensed segment of the paper web for separation by the user. The well improves sanitation of the dispenser. In a preferred aspect, the well may include a concave portion attached to an elongated upwardly inclined portion that extends to a discharge opening. In this manner, inclined surface keeps the dispensed segment abutted against the concave portion which prevents buckling of the paper for a low pull force configuration.

According to another aspect of the invention, a separating member in the well is provided so that the dispensed segment can be pulled against it to separate the segment with a substantially reduced pull force for perforated and unperforated paper. In a preferred aspect, the separating member separates the dispensed segment at a leading tear line with a substantially low pull force. In one aspect, the separating member may have a symmetrical straight configuration, but preferably has an angled configuration.

In another aspect, a separating member includes a stress riser portion configured to improve the propagation action through a tear line of a perforated sheet material. In one aspect, a separation member includes a stress riser in the form of at least one of a curved portion and a hook portion which may be spaced laterally on the separating member and extend towards the dispensed segment for reducing the pull force. In one case, the pull force is reduced to separate the dispensed segment from a continuous web of sheet material having spaced tear lines connecting predetermined segments of the sheet material.

According to another aspect of the invention, a separating member is pivotally configured so as to rotate to engage a control for actuating the feed mechanism for sheet material. In another aspect, a separating member pivots towards the discharge opening for controlling the feed mechanism responsive to a force applied to a portion of a dispensed segment. In yet another aspect, a separating member may rotate away from the dispensing opening responsive to the leading removable segment being separated from the web so as to control a feed mechanism. In these ways, a subsequent sheet segment may be provided to a user once a prior adjacent sheet segment is removed from a web of continuous sheet material to improve sanitation, reduce paper waste and save electrical energy.

In a preferred construction, the provision of a forward mounted holding well makes a dispenser easy to load and position for the sheet separation, allows providing fewer components to reduce manufacturing cost, and provides an easy clear paper path to prevent jamming of the sheet material.

In one aspect, a powered dispenser dispenses sheet material that solves the health and sanitation concerns for consumers. In another aspect, a dispenser provides perforated sheet material at a sufficiently low manual force to reliably separate sheet segments. In a preferred construction of a dispenser, the maximum pull force reduction may range from over 50% to over 89%. Thus, a dispenser of the present invention can meet the needs of certain individuals in the population, and establishments, which may use the dispenser to reduce costs and effectively service the public.

Accordingly, these and other aspects of the present invention provide an effective solution for establishments so that they may better serve a variety of people and segments of the population, including children and persons with disabilities that lack the fine motor control of the hand or fingers. Also, the present invention can eliminate the danger associated with freestanding tabletop dispensers.

These and other aspects, features and advantages of the present invention will be readily apparent and fully understood from the following detailed description of preferred embodiments, taken in connection with the appended drawings, which are included by way of example and not by way of limitation with regard to the claimed invention, in which like reference numerals identifying the elements throughout.

DETAILED DESCRIPTION OF THE PREFERRED EMBODIMENTS

Terms

Figure 1:
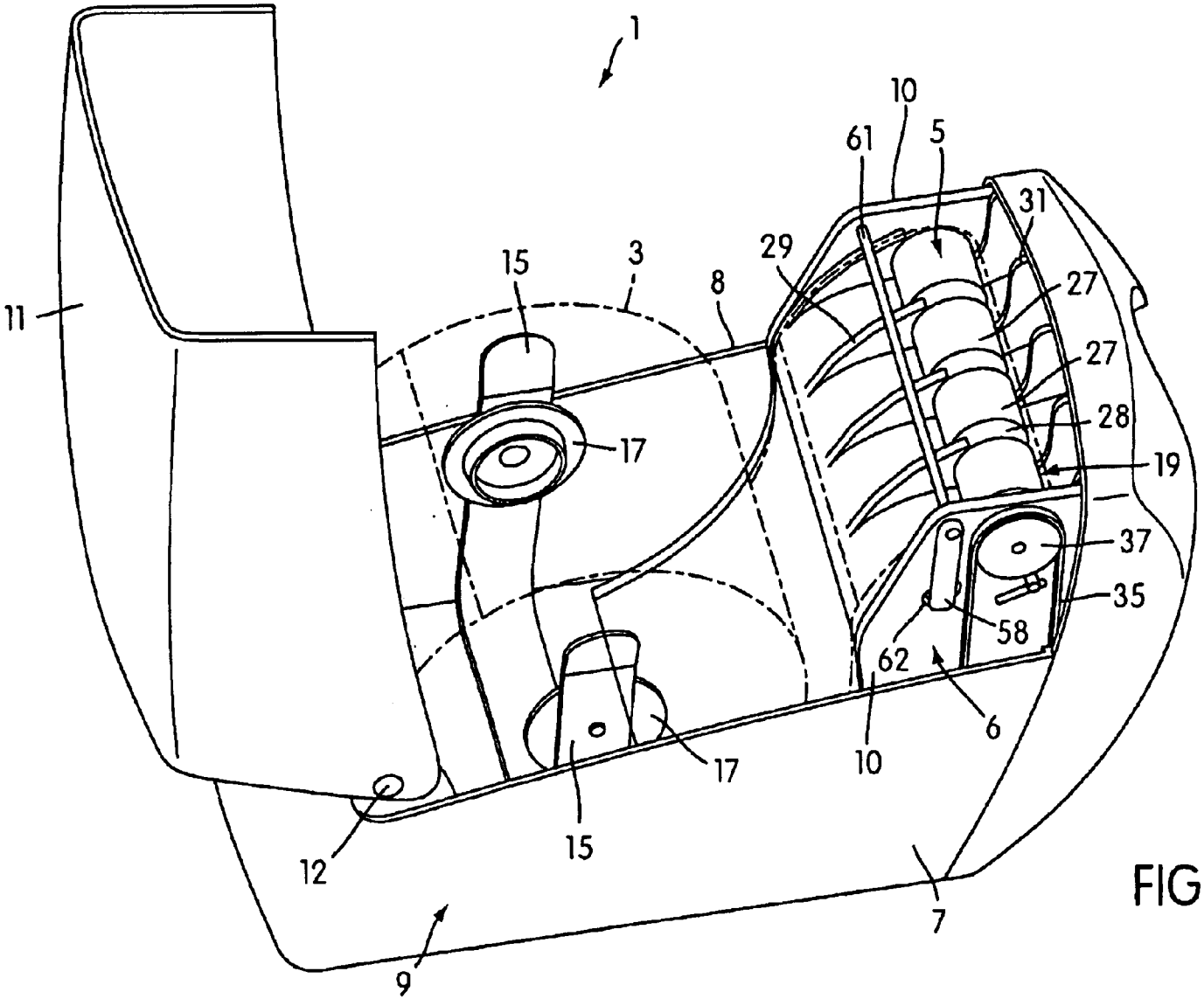
FIG. 1 is a schematic perspective view showing the environment of a dispenser according to the teachings of the present invention.

As used herein the terms "tensioning force" is defined as the magnitude of a tensile force that can place a sheet material in tension along a longitudinal length.

As used herein the terms "pull force" is defined as the requisite magnitude of a tensile force applied to sheet material that substantially initiates separation of a sheet material. For perforated sheet material, the separation occurs along a tear line.

FIGS. 1–7 and 9A, 9B and 10 illustrate an embodiment of a powered dispenser 1 for dispensing a continuous web of perforated sheet material 3 to a user with substantially reduced pull force. The perforated sheet material 3 may be paper towel sheets or folded napkins that have spaced predetermined tear lines, such as rows of prescored perforations that define individual of the sheet material. In a preferred arrangement, the perforated sheet material 3 is provided in a core wound roll. One example of napkins in a "Z-fold" arrangement with prescorced lines is shown in FIG. 8.

To provide a better understanding of the inventive dispenser 1, with reference to FIG. 3, a preferred embodiment is described in more detail below. Dispenser 1 may include an internal holding well or cavity 49 that retains at least one removable segment of the sheet material 3 to be separated from the web by a user. In one arrangement, the well 49 is configured as a gravity well to cooperate with gravity to keep the segment in a biased condition away from a dispensing opening. In another arrangement, a separating member 57, 57' cooperates with well 49 so that the removable segment can be separated at the tear lines with a substantially reduced pull force.

Figure 2:
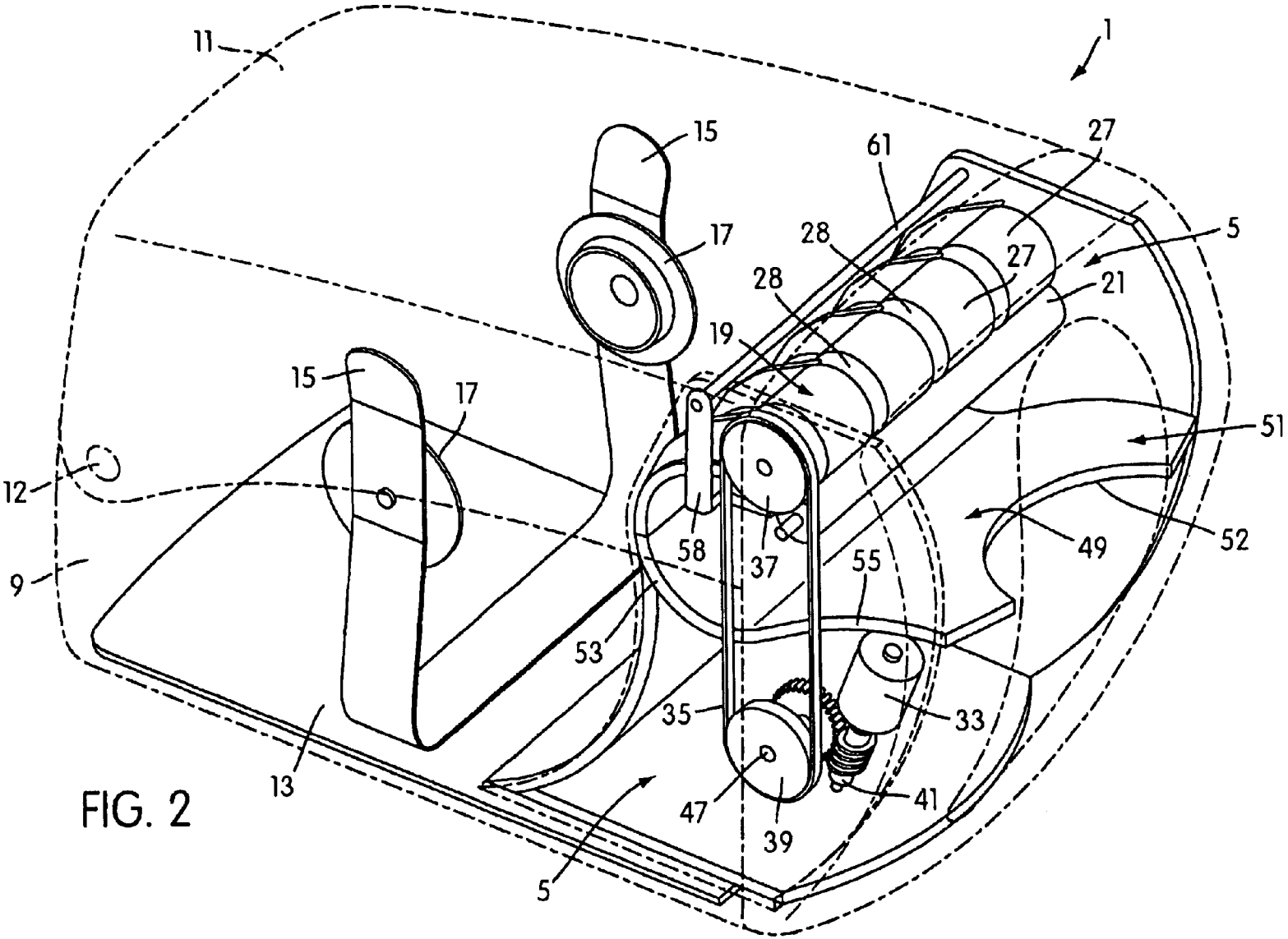
FIG. 2 is a schematic perspective view of the dispenser shown in FIG. 1 with the housing shown in phantom to reveal internal components therein.
Figure 3:
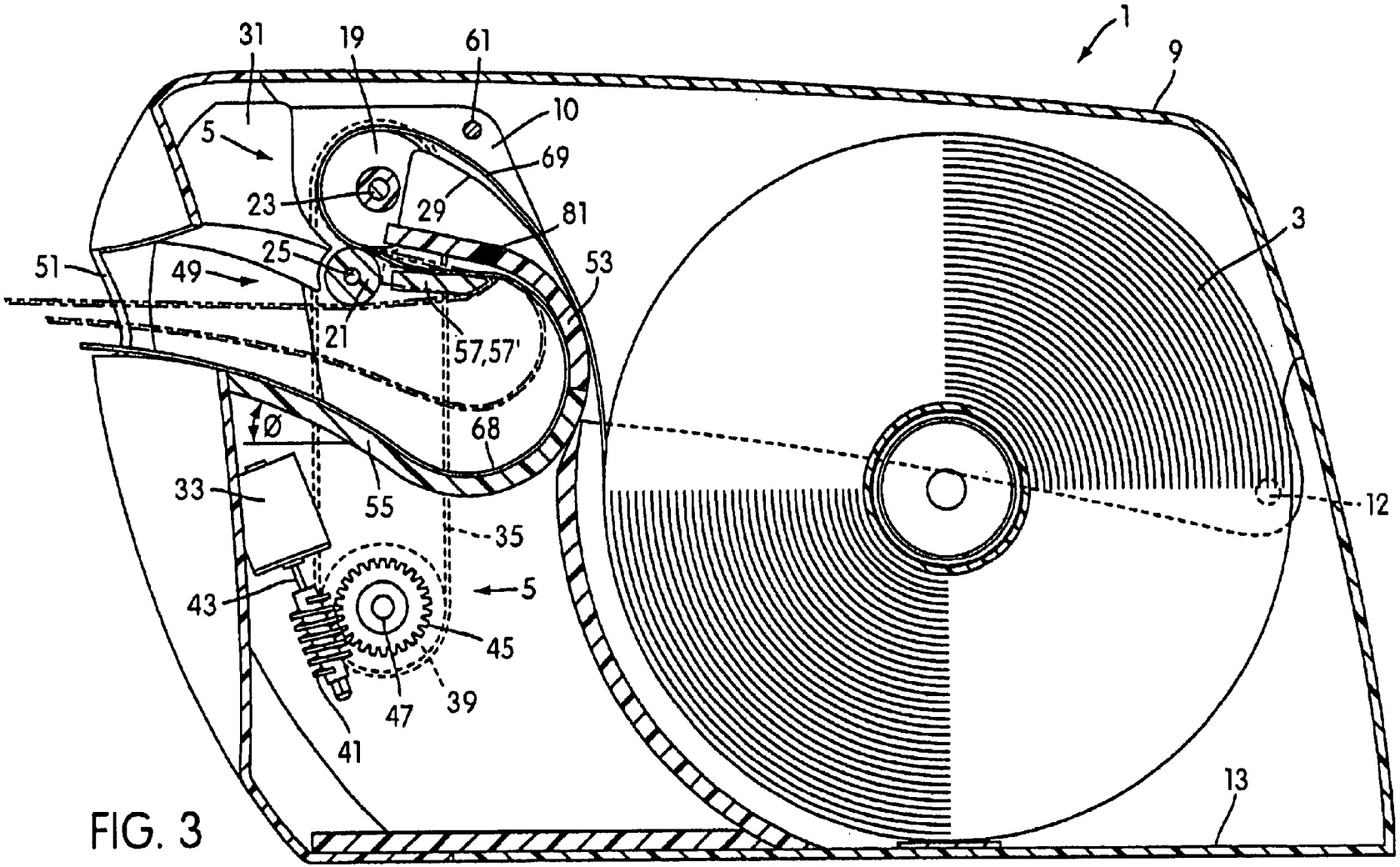
FIG. 3 is a schematic sectional side view of the dispenser shown in FIG. 1 with a dispensed sheet material therein.

Referring to FIGS. 1–3, dispenser 1 may use some or all of the aspects of powered paper dispensers disclosed in the U.S. patent applications Ser. Nos. 09/081,637 and 09/453,794 to Formon et al., titled "PAPER TOWEL DISPENSER" which are hereby expressly incorporated by reference. Other powered paper dispensers, however, can also be integrated and used. Nevertheless, in a preferred construction, dispenser 1 includes a feeding system 5 mounted to a chassis 6 within a dispenser housing 9 so as to dispense the perforated sheet material in single sheet segments. Chassis 6 has opposing upwardly extending side panels 10.

In a preferred construction as shown in FIG. 3, feeding system 5 includes a feed roller 19 and a pressure roller 21 which are respectively rotatably mounted to axles 23, and 25. Feed roller 19 may be any construction used to dispense sheet material 3 with pressure roller 21. In the illustrated embodiment, feed roller 19 comprises a plurality of spaced roller sections 27 having a spacing gap 28 interposed therebetween. As shown in FIGS. 1 and 3, rearward guide ribs 29 are provided within the gap 28 between the roller sections 27. Rearward guide ribs 29 support the sheet material 3 as it is fed from the roll into the feed roller 19. In the preferred construction, the upper surface of ribs 29 have an arcuate surface to assist in smoothly feeding of sheet material 3 to feed roller 19. Forward guide ribs 31 are provided to guide the sheet material 3 by deflecting the sheet material towards the nip of feed roller 19 and pressure roller 21. Forward guide ribs 31 are mounted opposite of and preferably aligned with rearward guide ribs 29.

Referring to FIGS. 1 and 3, pressure roller 21 is sufficiently spring-biased against the feed roller 19 to engage sheet material 3 therebetween and not induce premature tearing of the sheet material. In operation, feed roller 19 is belt-driven by an electric motor 33 mounted within the forwardly disposed discharge region of the dispenser 1. Of course, the motor 33 may be located in other regions of the dispenser. A worm 41 is affixed to drive shaft 43 of motor 33. Worm 41 meshes or otherwise engages the teeth of worm gear 45 which is rotatable affixed to a lower axle 47. A drive belt 35 is wrapped around pulley part 37 and the drive pulley part 39. The engagement of belt 35 with drive pulley part 39 and pulley part 37 may have a variety of configurations, such as a friction fit or toothed meshed arrangement. Nevertheless, as motor 33 turns drive shaft 43, worm 41 rotates the worm gear 45. Consequently, the rotation of pulley part 39 imparts motion to the belt 35, which rotates the pulley part 37 of feed roller 19. In operation, counter-clockwise rotation as viewed in FIG. 3, of the feed roller 19 against pressure roller 21 reliably advances sheet material 3 to an internal holding well 49 and a discharge opening 51 within the housing 9. The worm 41 and worm gear 45 are designed so that a braking mechanism is created when a segment of sheet material is separated from the roll. Nevertheless, other mechanisms may be used to advance the sheet material 3 in dispenser 1 towards discharge opening 51.

Dispenser housing 9 includes a top cover 11 pivotally mounted by a pin, hinge 12 or other conventionally known manner. Top cover 11 rotates upward (counter-clockwise in FIG. 1) so that a roll of sheet material 3 can be loaded into dispenser 1. As shown in FIG. 2, dispenser housing 9 can support the dispenser 1 on a generally flat surface. A floor panel 13 of the housing 9 can support the dispenser 1 on a horizontal surface such as, a countertop or a tabletop. Nevertheless, the dispenser 1 could be mounted on a vertical wall in a cantilevered configuration with the floor panel extending perpendicular to the wall. The sheet material 3 is rotatably supported by a pair of arms 15 extending upwardly from floor panel 13. Each of the arms includes inwardly directed hub 17 loosely received within the core of the roll of sheet material 3 to enable free rotation thereabout during a dispensing operation.

Figure 4:
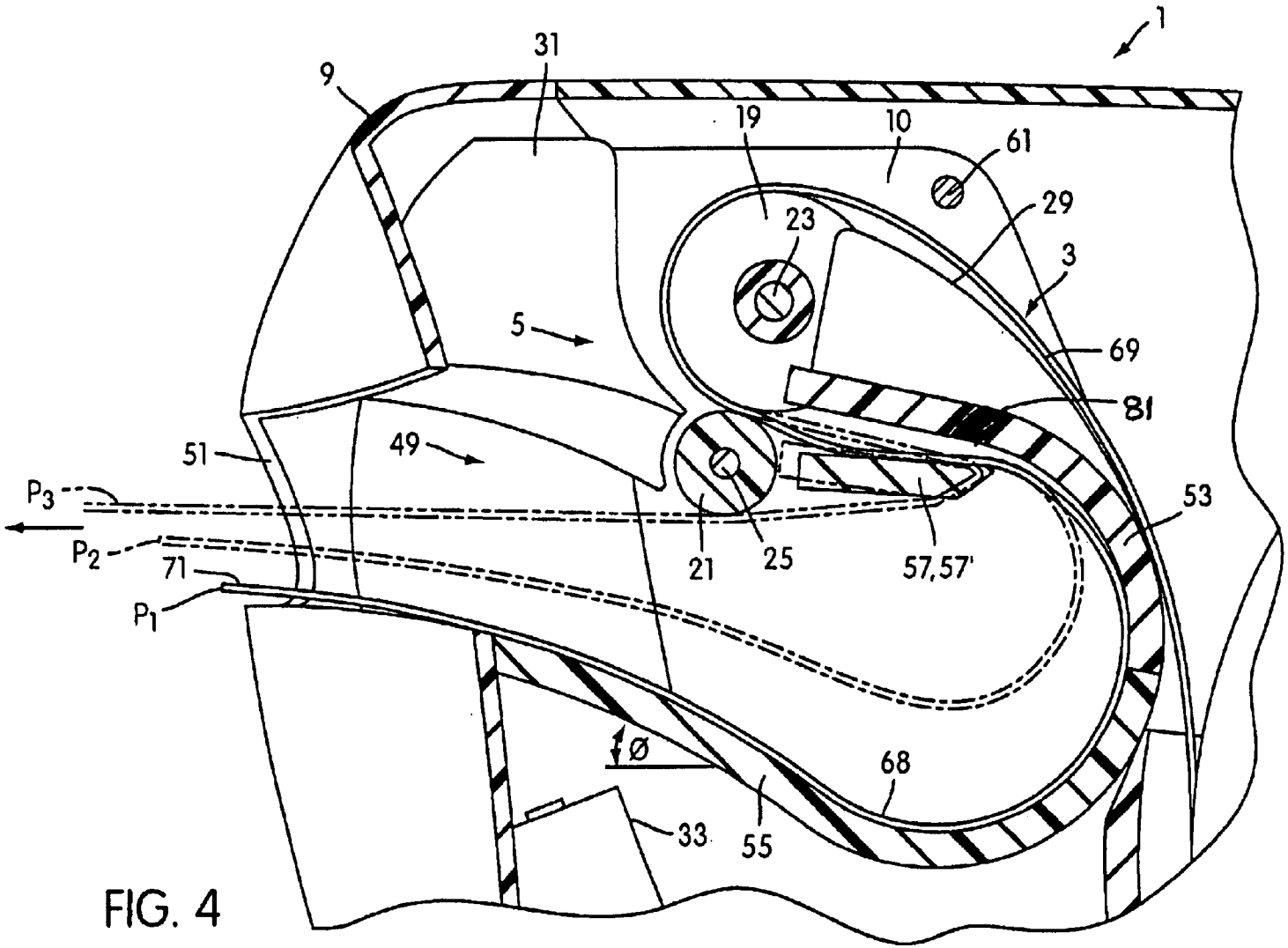
FIG. 4 is a similar schematic sectional side view as FIG. 3 enlarged to illustrate an operational sequence of a separation operation according to the teachings of the present invention.

In an embodiment as illustrated in FIGS. 3 and 4, an anterior region of dispenser 1 includes the internal well 49 downstream of the nip, which retains one dispensed segment 68 of the sheet material 3 for eventual separation from the web by a user. The downstream longitudinal length of the dispensed segment 68 may be retained on the peripheral distance of the well 49 to keep the segment 68 internal and to provide a compact anterior dispensing region. The internal well 49 may take on a variety of shapes. In a preferred construction, the shape of the well 49 is defined by a backwall portion 53 and an elongated inclined portion 55 that extends upwardly to discharge opening 51. In a more preferred construction, to provide a compact sized dispenser 1, the backwall portion 53 is provided posterior to the feed roller 19 axle 23. It should be recognized that the well 59 also provides a sanitary feature by substantially reducing the exposure the dispensed segment to the environment.

The backwall 53 may have a concave shape, which generally resembles a semicircular cross-sectional shape. The concave shape provides an efficient compacting feature to retain dispensed sheet 68 within the well 49. In operation, as feed roller 19 rotates, the leading edge or free edge of the sheet material 3 substantially advances on the concave inner surface of the backwall 53 then subsequently travels on to the upwardly inclined portion 55. In use, backwall 53 of well 49 guides the sheet material reward, then forwardly towards the discharge opening 51. The concave shape of backwall 53 assists in smoothly positioning the dispensed segment so that the separation at the tear line of the dispensed segment from the roll along a separating member 57, 57' occurs at a low separation force.

With continued reference to FIGS. 3 and 4, the angle Φ of inclined portion 55 may be provided an acute angle ranging between 10 degrees to 40 degrees and preferably ranging 15 degrees to 30 degrees with respect to a horizontal surface, such as floor panel 13. Nevertheless, other angles may be used if other stiffness and/or the bending resiliency characteristics of the sheet materials are desired. In use, inclined portion 55 reliably positions a rear portion of the dispensed segment 68 abutted against the inner surface of backwall 53 without causing the dispensed segment to buckle or gather together. Accordingly, a relatively stiff paper will have a greater angled inclined portion than a dispenser for a relatively lower stiffness paper. In this manner, the adjustment of the angle Φ of portion 55 keeps the dispensed segment 68 abutted against the backwall 53 by generally utilizing the force of gravity to slide down the incline portion.

Figure 5:
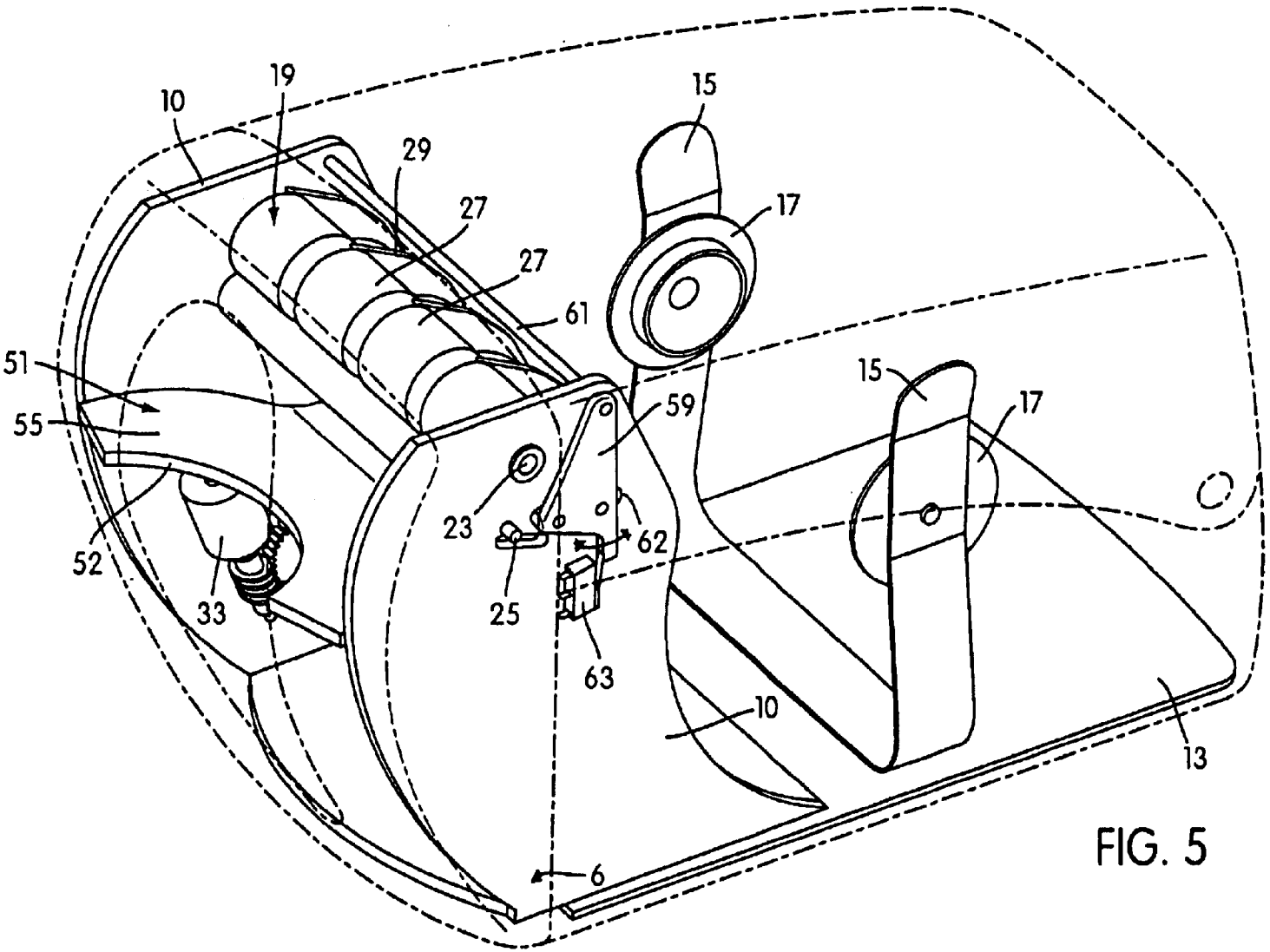
FIG. 5 is a similar schematic perspective view as FIG. 2 showing the other side of the dispenser of FIG. 1.

In the arrangement shown in FIG. 3, the leading portion of the dispensed sheet segment may slightly extends from (approximately ½ to 1 inch) the discharge opening 51 so that a user can reliably grasp and pull the sheet segment from the dispenser 1. Alternatively, the leading portion may be retained within the housing so that a user can access the dispensed segment. As shown in FIGS. 2 and 5, dispenser 1 may include a semicircular grip portion 52 at the terminus of the incline portion 55 to allow the user to grip the dispensed segment.

The inventive construction of dispenser 1 further includes separating member 57, 57' mounted in a spaced relationship from the inner surface of backwall 53 in well 49. Separating member 57, 57' is preferably mounted so that the dispensed segment 68 can be easily separated from the perforated sheet material 3 at a leading tear line 64 (see FIG. 8) with a substantially reduced pull force. Sheet material 3 is fed between the gap formed by the member 57, 57' and backwall 53. In one construction, separating member 57, 57' may be formed as a blade having a sharp edge that slices through the perforations of the sheet material or part of a sheet material without perforations. Nevertheless, a non-sharp edge could be employed as well. The blade may be constructed from a variety of materials, such as a metal material, a rigid plastic or a rigid plastic base and metal edge.

Figure 6:
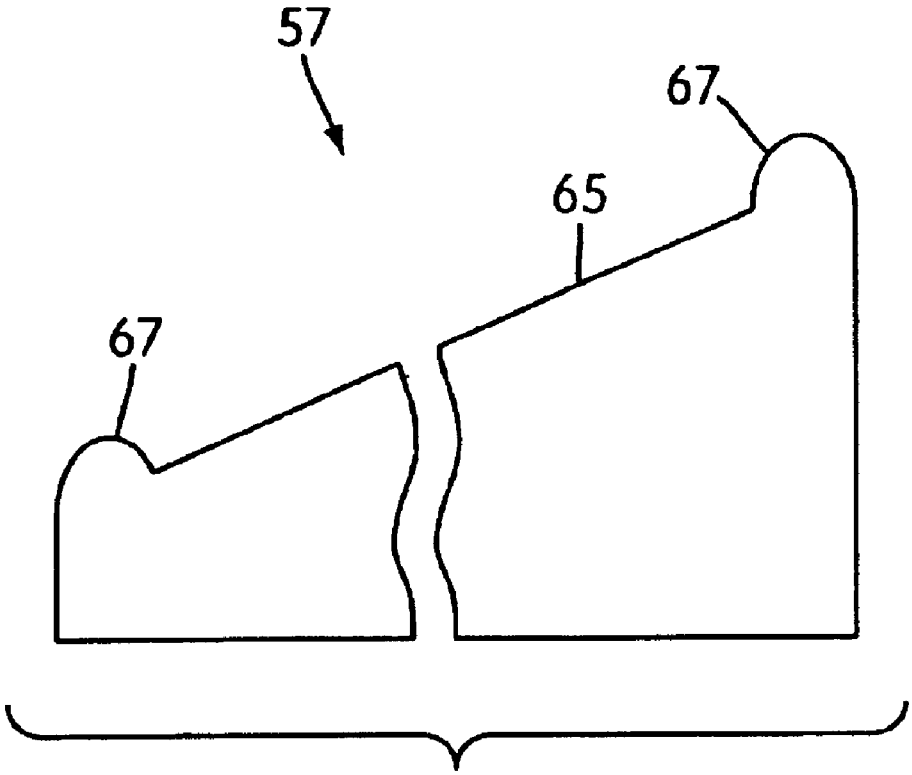
FIG. 6 is a schematic plan view of a portion of a first blade member that can be used in the dispenser of FIG. 1.
Figure 9A:
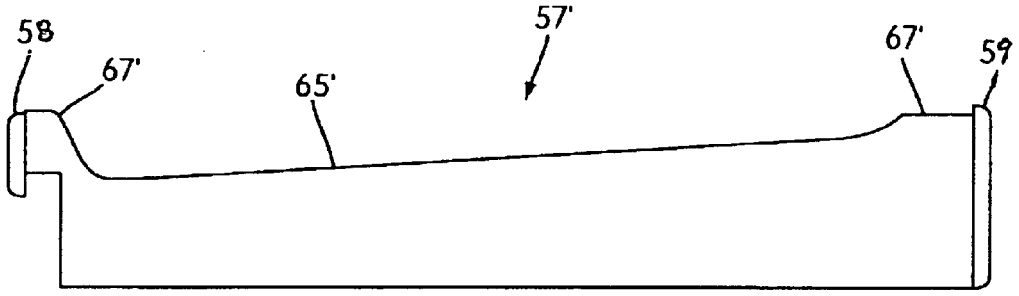
FIG. 9A is a schematic plan view of a second blade member that may be used in the dispenser of FIG. 1.
Figure 9B:
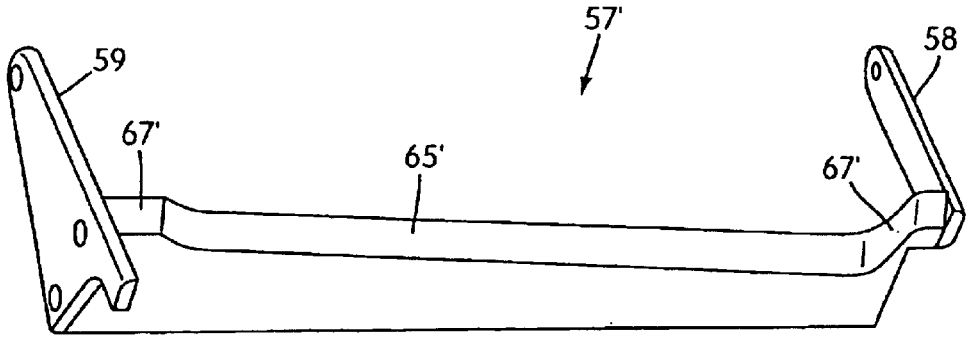
FIG. 9B is a schematic perspective view of the blade member of FIG. 9A.

Referring to FIGS. 6, 9A, and 9B separating member 57, 57' may be preferably constructed from a blade in an asymmetric arrangement, which contributes to a reduced pull force action by enhancing propagation of the tearing along perforations. In one asymmetrical arrangement, blade 57, 57' includes an angled tip 65, 65' having approximately a 3%-5% slope. The blades may have stress riser members 67, 67' that are formed as protrusion portions which generally extend from the tip towards the sheet material. The stress riser members can be laterally spaced with two or three on the tip. The stress riser portion provides for a reduced pull force of a dispenser.

Figure 10:
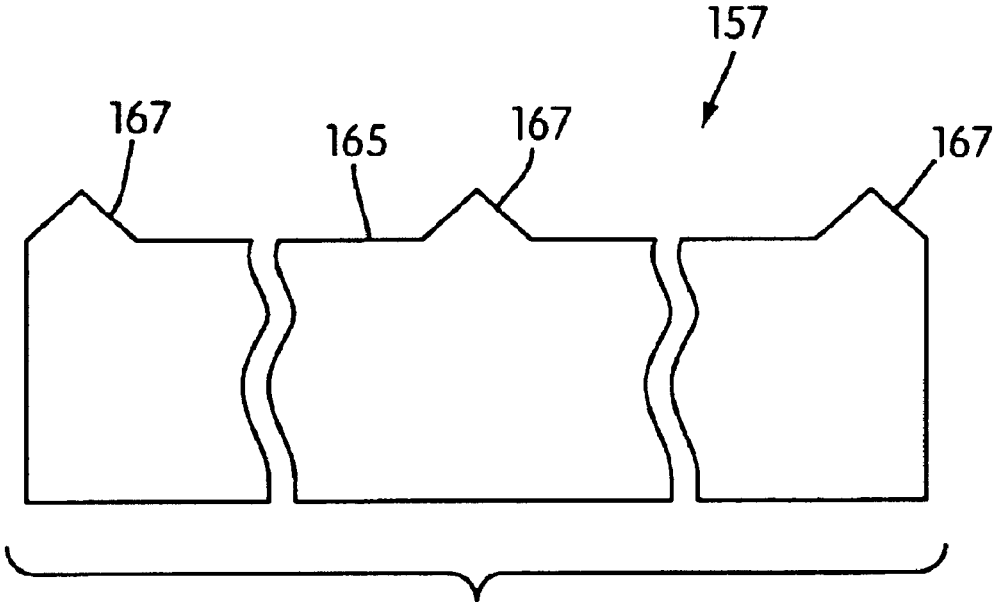
FIG. 10 is a schematic plan view of a portion of a third blade member that may be used in the dispenser of FIG. 1.

In one arrangement, referring to FIG. 10, a separating member 157 can have a generally straight tip 165 with at least one stress riser portion 167 located on the lateral sides of the separating member 157. Alternatively, a stress riser portion 167 can be located generally at the center of member 157. In this way, the lateral side configuration allows a person to start removal of the sheet segment from a left or right of the dispensing opening 51. A central location of member 167 also allows improved separation of the dispensed segment. Nevertheless, the stress riser portions 167 can be a variety of shapes. In use, when the tear line is located at the stress riser portions 167 in tension for separation, a point load is placed on the tear line which causes an unbalanced load condition on the tear line. Accordingly, the stress riser portions 167 enables the separation of the dispensed segment at the tear line to start at the outermost ends, or center and propagate the tearing action to the ends with substantially less force.

In one arrangement, the blade 57 may have another type of stress riser portion formed as a curve portion 67. Accordingly, blade 57 may include at least one curve portion 67 which extends from the tip 65 at one end (see FIG. 6). In another arrangement, a stress riser portion may be formed as a hook portion 67' shown on blade 57' in FIGS. 9A and 9B. The curve portion 67 and hook portion 67' reliably induces propagation in bursting the tear line to start the tearing action once the paper has a tensioning force applied. Of course, another curve portion or hook portion may be provided at the opposing end of the blade 57, 57'. In this case, the blade has two protruding members (portions 67, 67') that contacts the paper and a central region between the protruding members. Alternatively, the curve portion 67 or hook portion 67' can be also provided on a straight blade, but has additional benefits for a sloped blade tip. In a more preferred construction, the curve portion 67 is convexly shaped. The construction of the blade 57, 57' advantageously causes the tip 65, 65' to reliably burst through the tear line of the sheet material at generally an increased point stress on the perforations.

Purely by way of example without limitation of the present invention, a pull force can be measured with a spring tensioning device attached to a sheet segment generally at the longitudinal axis along the length. In one baseline case, a pull force to separate perforated sheet segments without a separating member may range above 3 lbs to as high as 5 lbs or more. As can be appreciated persons with insufficient musculoskeletal strength could have difficult time. By using the teachings of the present invention, the pull force can be significantly reduced. In one example, a separating member embodied in a symmetrical straight blade can result in a pull force of approximately 1.43 lbs. This is approximately over a 71.4% reduction in the maximum pull force. In another example, a separating member embodied in an angled blade can result in a pull force approximately of 1.13 lbs. This is in the order of over a 77% reduction in the maximum pull force. In yet another example, the separating member of the type in the geometry shown in FIGS. 9A and 9B can result in a low pull force of approximately 0.53 lbs. Advantageously, this configuration provides over 89.4% reduction in the pull force. As can be appreciated, the maximum pull force reduction with the present invention may range from over 50% to over 89%.

The separating member 57 can be stationary in the dispenser 1. Nevertheless, in a preferred construction, referring to FIGS. 1-3 and 5, separating member 57 pivots about a rod 61 to control the dispensing of a subsequent removable sheet segment. In dispenser 1, rod 61 spans the opposing side panels 10 within the dispenser housing 9 and is pivotally mounted to chassis 6. The opposing longitudinal ends of blade 57, 57' each have pivot members 58, 59 that extend upward to and are attached to rod 61. A portion of pivot members 58, 59 at the ends of blade 57, 57' extends through a slot 62 in each side panel 10 so that the blade 57, 57' can freely pivot. Nevertheless, other ways may be implemented to enable pivotable rotation of blade 57, 57'. In one example, in lieu of a rod, individual pins (not shown) extending through holes in each sidewall 7, 8 may be mounted the upper end of pivot members 58, 59.

When a user is separating a dispensed removable segment from the web, blade 57, 57' pivots about rod 61 towards discharge opening 51 (clockwise as shown in FIGS. 3 and 4). At the completion of the rotation about rod 61 (see FIG. 4 dotted lines of blade 57, 57'), the pivot member 59 disposed at side panel 10 shown in FIG. 5, actuates a control switch 63, such as a reed switch or a limit switch. Nevertheless, other types of triggers, controls, and switches may be used with the dispenser 1 and the may be located at other positions.

In the inventive dispenser, engagement of the control switch 63 indicates that the segment has been separated so that the motor operated drive roller rotates to advance a subsequent removable sheet segment into the well 49 which provides a fast feeding of the subsequent sheet. In an alternative construction, the pivot member can freely rotate away from the dispensing opening when a segment is removed. A free rotation away from the dispensing opening can also engage a control switch, if a slight delay in feeding a subsequent sheet is acceptable for the intended use. The forward end and rear end of slots 62 provides a stopping mechanism for the rotation of the blade. Nevertheless with a pivotable separating member 57, 57', an individual removable segment can be provided to a user in response to the leading sheet segment being separated from the web.

FIG. 4 schematically illustrates a separation action of a dispensed segment 68 of sheet material 3 as carried out on the inventive dispensing geometry of dispenser 1. For ease of explanation, FIG. 4 depicts three positions of a dispensed segment 68 during a separation action from the roll of sheet material 3. It should be understood that the separation action of the dispensed segment 68 includes other intermediate positions not shown for clarity. A first position is defined when the dispensed segment 68 is at a resting orientation generally abutted against the backwall 53 and the inclined portion 55 shown in solid lines in FIG. 4, denoted "$P_1$". In general, the resting orientation occurs from the inventive geometry of the holding well 49 by utilizing the gravitation force to exert downward pressure to pull the dispensed segment 68 against inclined portion 55 and backwall 53. In this first position, a leading portion 71 of the segment 68, such as ½ inch to 1 inch, is presented to a user so that they may grasp the segment 68 with their fingers, for example. In addition, in the first position, dispensed segment 68 has no pull force applied or a zero pull load.

With continued reference to FIG. 4, a second intermediate position "$P_2$" is shown, such that the user grips the leading portion 71 and pulls the segment through the discharge opening 51. In the second position, a pulling load provides forward momentum to the segment which lifts the segment off the backwall 53 and/or inclined portion 55. Continued forward momentum, causes the segment to contact blade 57, 57' can create a tensioning force that rotates blade 57, 57' clockwise about rod 61 as shown in FIG. 4. In a third position "$P_3$", clockwise motion of blade 57, 57' is stopped by abutting the forward end slots 62. At this point in the process, the segment becomes generally taut and the leading tear line may become generally aligned with the tip 65, 65' of blade 57, 57'. In this point in the dispensing action, a pull force on the segment 68 allows the tip 65, 65' of blade 57, 57' to separate the segment at the tear line. Of course a blade member 157 can be used as well. In a more preferred construction, an asymmetrical blade can reduce the magnitude of the pull force needed to separate segment 68 from the web. A further reduction in the pull force occurs with the stress riser portions 157, such as curve portions 67 or hook portions 67' of blade 57, 57'. It should be appreciated that the separating members pivot under a force manually applied to a sheet segment and sheet segment is separated with such force. In this configuration and operation, there is no electrical energy used to separate the paper at the tear line. Accordingly, the system is more energy efficient thereby increasing battery life and the cycle time between battery changes.

Figure 7:
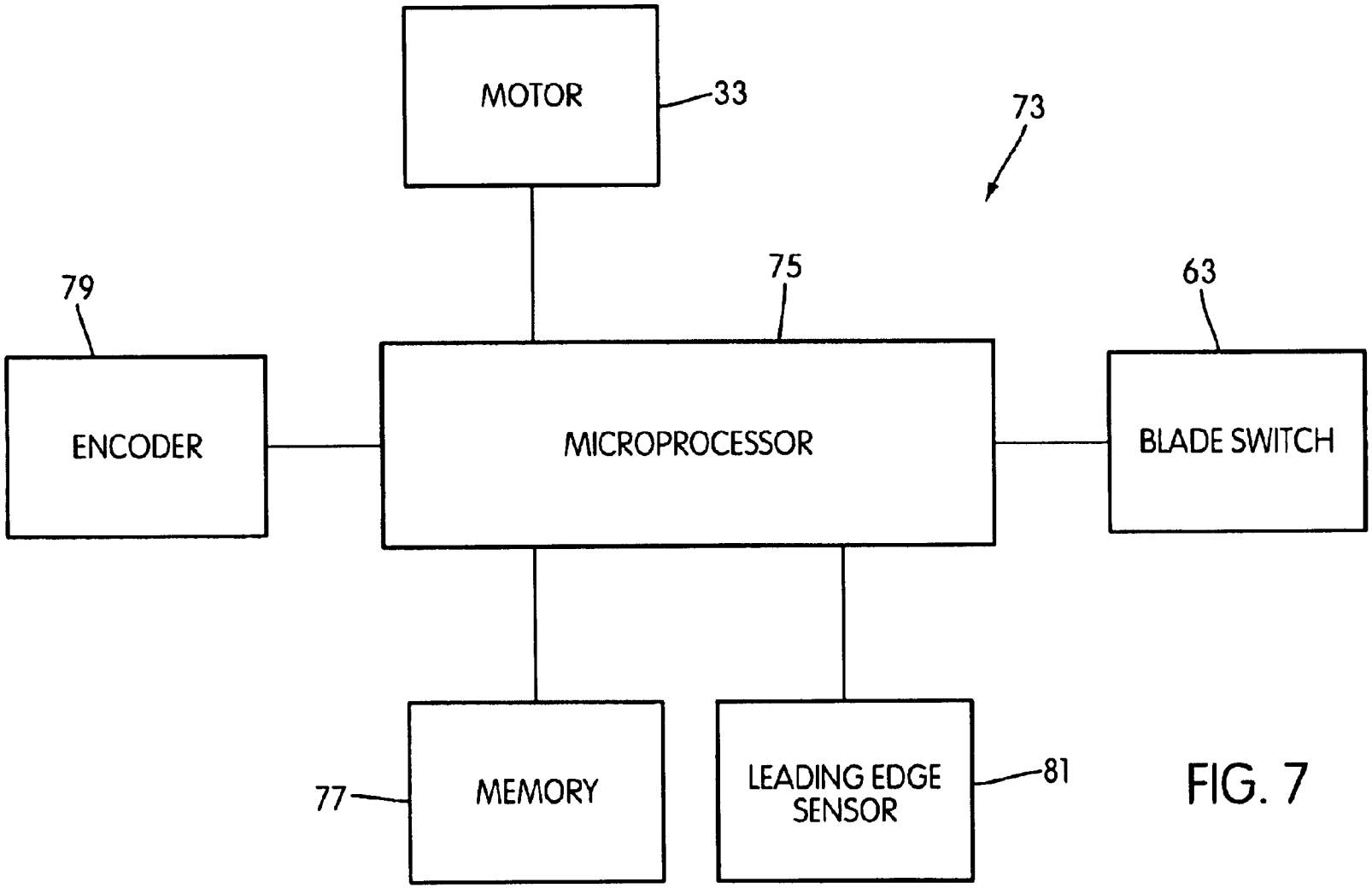
FIG. 7 is a schematic diagram of a control circuitry for the dispenser shown in FIG. 1.
Figure 8:
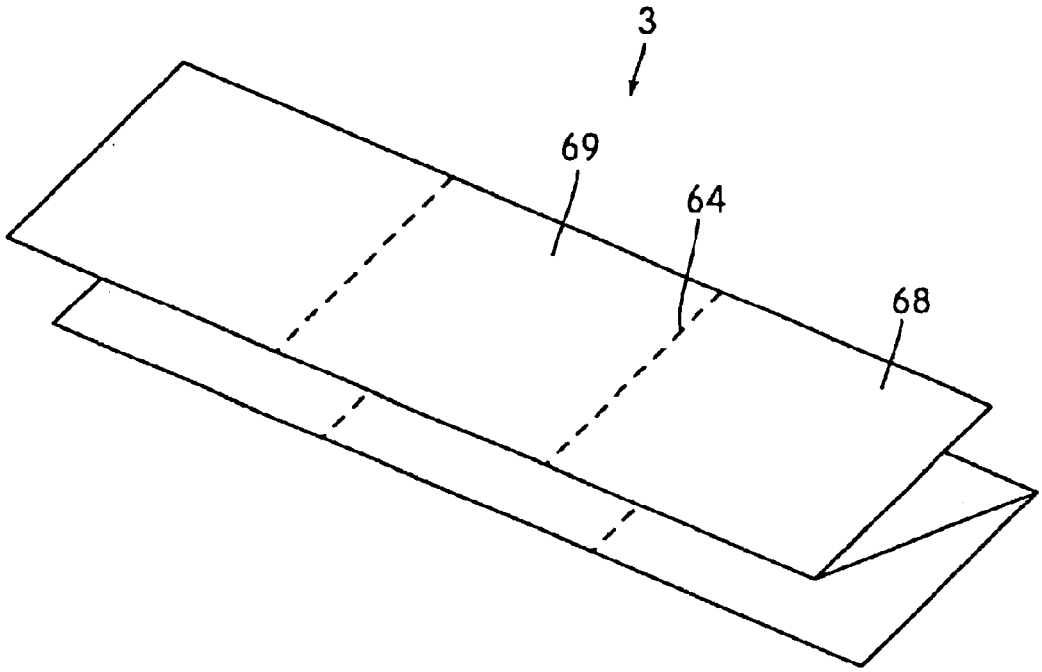
FIG. 8 is a schematic perspective view of a type of perforated sheet material that may be delivered by dispenser shown in FIG. 1.

With reference to FIG. 7, dispenser 1 may include a control circuitry 73 to dispense perforated sheet material 3 into holding well 49 for subsequent separation by a user. The control circuitry 73 may include a microprocessor 75 with operating software. Control circuitry 73 may also include an operable connection to memory 77. In general, memory 77 stores computer readable data installed or programmed to carry out the dispensing operation of motor 33 and feed roller 19. Memory 77 can be any type, which provides nonvolatile storage that can be electrically erased and/or reprogrammed. In one arrangement of the dispenser 1, the memory may include read only memory ("ROM") and random access memory ("RAM").

In order to control the amount of sheet material fed so that the desired amount is delivered, dispenser 1 preferably employs a length detector 79 (see FIG. 7), which establishes the length of sheet material 3 during the dispensing cycle, each time the motor 33 is activated. The length detector 79 may be, for example, an encoder, either electromechanical or optical, which outputs a pulse for increments of sheet material advanced by feed roller 19. The length detector 79 may be coupled to microprocessor 75 used to control the operation of the motor 33 and feed roller 19. An alternative to encoding the successive incremental displacements of the perforated sheet material is to detect the difference in transmissivity of the sheet material when a perforation line crosses an optical interrupter as discussed in the above mentioned U.S. patent applications to Formon et al. which are incorporated by reference.

When an encoder is employed to dispense the proper amount of paper product, the microprocessor 75 may count the number of pulses generated by the length detector 79 and continue to operate the motor 33 until the proper number of pulses has been counted to align the perforation lines at the tip 65, 65' of the rearward facing blade 57. For example, when the perforation lines are four inches apart for each napkin on the roll the motor 33 and the feed roller 19 will operate until the number of pulses that correspond to four inches have been counted. In a preferred construction, the leading edge of the sheet material 3 is advanced until sensed by an edge sensor 81 positioned in holding well 49 (see FIG. 4). The edge sensor cooperates with microprocessor 75 and length detector 79 to reduce the accumulation of error over the length of the roll of perforated paper. The edge sensor generally resynchronizes the length detector 79 to align the tear line 64 of the dispensed segment 68 and subsequent segment 69 to tip 65, 65' of blade 57, 57'.

In use, after a segment is separated from the roll or on initial loading of the roll into the dispenser, microprocessor 75 controls operation of motor 33. Referring to FIGS. 5 and 7, when control switch 63 is engaged by pivot member 59, microprocessor 75 sends an activation signal to the motor 33 and instructs it to drive the feed roller 19. The edge sensor senses the leading edge of the segment of perforated paper and microprocessor actuates length detector 79 to start counting at that point. The motor 33 and feed roller 19 continue to operate and cause the sheet material 3 to be dispensed until the predetermined number of pulses have been counted by length detector 79. When the predetermined number of pulses have been counted, the motor 33 and the feed roller 19 are stopped. Sheet material 3 in then in position for separation from the roll by the customer. Microprocessor 75 operates in a conventional manner. Specific implementations of the microprocessor is well known to those skilled in the art, and include for example, integrated circuits manufactured by the INTEL® Corporation.

The provision of the forward mounted holding well 49 makes the dispenser 1 ease to load and position for the sheet separation, allows fewer components, and provides an easy to clear paper path to prevent jamming of the sheet material. In alternative constructions, backwall 53 and portion 55 can be formed as a unitary structure, such as a plastic molded or casted metal configuration. A unitary construction can reduce assembly costs of the dispenser 1.

Thus, the various aspects of a dispenser described above can provide an effective solution for establishments so that they may better serve a variety of people and segments of the population, including children and persons with disabilities that lack the fine motor control of the hand or fingers. Advantageously, a subdivision of the population who may be amputees or have less than full use or their arms and fingers can reliably separate the sheet material 3 with a dispenser at a significantly low pull force. Also in a preferred construction, a dispenser according to an embodiment can eliminate a danger with freestanding tabletop dispensers that have perforated paper.

While the present invention has been described with reference to preferred and exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention include all embodiments falling within the scope of the appended claims.

What is claimed is:

1. A dispenser for a continuous web of sheet material having spaced tear lines defining individual removable segments of the sheet material in which a leading removable segment has a free edge and an opposing tear line, comprising:

a housing having a discharge opening;

a support within the housing for supporting the web;

a powered feed mechanism configured to advance a leading removable segment of the sheet material towards the discharge opening; and a gravity well configured to hold the leading removable segment therein under a slidable condition away from the discharging opening, and the gravity well sized for retaining the leading removable segment therein in which the free edge of the leading removable segment is accessible from the discharge opening for application of a pull force thereon.

2. The dispenser in accordance with claim 1, further including a separating member having an edge portion configured to be generally aligned with the opposing tear line for separating the leading removable segment from the web of sheet material when the pull force is applied to the free edge of the leading removable segment.

3. The dispenser in accordance with claim 2, in which the gravity well includes a concave portion for holding the leading segment therein.

4. The dispenser in accordance with claim 3, in which the gravity well is further defined by an inclined portion extending upwardly to the discharge opening from the concave portion so that the leading segment rests on the concave portion and the elongated inclined portion before separation from the web at the opposing tear line of the leading segment.

5. The dispenser in accordance with claim 4, in which the elongated inclined portion is disposed at an angle between 10 degrees to 40 degrees with respect to a horizontal plane generally parallel to a floor panel of the housing.

6. The dispenser in accordance with claim 4, in which the angle of the elongated inclined portion ranges from 15 degrees to 30 degrees.

7. The dispenser in accordance with claim 4, in which the concave portion and the elongated inclined portion are formed as an unitary member.

8. The dispenser in accordance with claim 3, in which the separating member is pivotally supported so as to rotate to engage a control for actuating the feed mechanism.

9. The dispenser in accordance with claim 8, in which the separating member rotates towards the dispensing opening responsive to the pull force applied to the free edge of the leading removable segment.

10. The dispenser in accordance with claim 8, in which the separating member rotates away from the dispensing opening responsive to the leading removable segment being separated from the web.

11. The dispenser in accordance with claim 8, in which the edge portion of the separating member extends laterally at a slope ranging between 1% to 3%.

12. The dispenser in accordance with claim 8, further including a control circuitry configured to control the feed mechanism.

13. The dispenser in accordance with claim 3, in which the concave portion is horizontally aligned with the discharge opening.

14. The dispenser in accordance with claim 2, in which the edge portion of the separating member is angled.

15. The dispenser in accordance with claim 2 in which the edge portion includes a stress riser component for the opposing tear line.

16. The dispenser in accordance with claim 15, in which the stress riser component is one of a laterally disposed curve portion and hook portion extending from the edge portion.

17. A dispensing apparatus for an absorbent paper product of sheet material having spaced tear lines defining individual removable segments of the sheet material in which a leading segment has a free edge and an opposing tear line, comprising:

a housing having a discharge opening;

a support for supporting the sheet material;

a feeding system for advancing a leading segment of the sheet material towards the discharge opening and generally aligning the opposing tear line of the leading segment;

a separating component configured pivot so as to be generally aligned with the opposing tear line of the leading segment for separating the leading segment from the web of sheet material when a force is applied to the free edge of the leading segment; and a holding portion for retaining the leading segment of the sheet material therein such that the leading segment is prevented from buckling therein in which the free edge of the leading segment is accessible from the discharge opening for application of the force thereon.

18. The dispensing apparatus m accordance with claim 17, in which the holding portion includes an arcuate region for retaining the leading segment.

19. The dispensing apparatus m accordance with claim 17, in which the holding portion includes an elongated inclined region extending upwardly to the discharge opening from the an region so that the leading segment rests on the arcuate region and the elongated inclined region under the force of gravity prior to separation at the opposing tear line of the leading segment.

20. The dispensing apparatus in accordance with claim 17, in which the separating component includes a triggering member adapted to pivot with respect to the discharge opening so as to actuate the feed mechanism responsive to the force applied to the free edge of the leading segment.

21. The dispensing apparatus in accordance with claim 20, in which the separating component includes a stress riser element adapted to engage the opposing tear line.

22. The dispenser apparatus in accordance with claim 21, in which the stress riser element includes one of a hook and a curved element.

23. A dispensing apparatus for a continuous web of sheet material having spaced tear lines defining individual removable segments of the sheet material in which a leading removable segment has a free edge and an opposing tear line, comprising:

a housing having a discharge opening;

a support within the housing for supporting the web;

a powered feed mechanism configured to advance a leading removable segment of the sheet material towards the discharge opening;

a severance element having an peripheral portion adapted to separate the leading removable segment from the web at the opposing tear line and the severance element having a control component configured to pivot so as to actuate the feed mechanism responsive to a force applied to the free edge of the leading removable segment;

a control processor configured to control the feed mechanism to advance a subsequent leading removable segment into a dispensing position for an opposing tear line to be generally aligned with the peripheral portion of the severance element; and a dispensing cavity sized for retaining the leading removable segment therein in which the free edge of the leading removable segment is accessible from the discharge opening for application of the force thereon.

24. The dispensing apparatus in accordance with claim 23, in which the severance element is pivotally configured towards the dispensing opening responsive to the force being applied to the free edge of the leading removable segment.

25. The dispensing apparatus in accordance with claim 24, in which peripheral portion includes one of a hook element and a curved element for separating the leading removable segment from the web.

26. The dispensing apparatus in accordance with claim 25, in which the dispensing cavity includes a dispensing control member operable with gravity to hold the leading removable segment in a biased mode away from the dispensing opening.

27. The dispensing apparatus in accordance with claim 26, in which the dispensing control member includes a grip portion for application of the force.

28. The dispensing apparatus in accordance with claim 26, in which the dispensing control member includes an inclined member providing said biased mode.

29. The dispensing apparatus in accordance with claim 23, in which the severance element is pivotally configured away from the dispensing opening in response to the leading removable segment being separated from the web.

* * * * *